United States Patent [19]

Knudsen

[11] 4,101,687

[45] Jul. 18, 1978

[54] ELECTROSTATIC COATING METHOD

[75] Inventor: Walter Ganter Knudsen, Bethany, Conn.

[73] Assignee: Electrostatic Equipment Corporation, New Haven, Conn.

[21] Appl. No.: 604,323

[22] Filed: Aug. 13, 1975

[51] Int. Cl.[2] ..... B05D 1/04; B05D 1/06; B05B 5/00

[52] U.S. Cl. ..... 427/25; 427/27; 427/33; 427/35; 427/38; 427/42; 427/44; 427/185; 427/195

[58] Field of Search ..... 118/629, DIG. 5, 309; 427/25, 27, 33, 35, 37, 38, 39, 42, 44, 185, 195

[56] References Cited

U.S. PATENT DOCUMENTS

| | | | |
|---|---|---|---|
| 3,004,861 | 10/1961 | Davis | 427/185 |
| 3,326,182 | 6/1967 | Inoue | 118/629 |
| 3,623,453 | 11/1971 | Seimiya et al. | 118/309 |
| 3,640,246 | 2/1972 | Jeromin et al. | 118/629 |
| 3,641,971 | 2/1972 | Walberg | 118/629 X |
| 3,646,910 | 3/1972 | Cade et al. | 118/629 |
| 3,670,699 | 6/1972 | Sargent | 427/185 X |
| 3,716,024 | 2/1973 | Pierson | 118/629 |
| 3,799,112 | 3/1974 | Huteaux | 118/629 |
| 3,914,461 | 10/1975 | Goodridge | 427/33 |

*Primary Examiner*—Ronald H. Smith
*Assistant Examiner*—Shrive P. Beck

[57] ABSTRACT

Coatings of particulate materials are produced by the use of a highly ionized gas which, in turn, is employed to electrostatically charge the particles. The ionized gas is generated at location that is remote from the place at which it is passed through the particulate material, thus providing outstandingly safe operating conditions without sacrifice of the efficiency, uniformity or reliability of electrostatic charging.

9 Claims, 6 Drawing Figures

ELECTROSTATIC COATING METHOD

This is a division of application Ser. No. 398,425, filed Sept. 18, 1973, and now issued as U.S. Pat. No. 3,916,826.

BACKGROUND OF THE INVENTION

Methods and apparatus for coating a wide variety of workpieces by the electrostatic deposition of a particulate material thereon are well known in the art. Highly satisfactory and effective electrostatic coating apparatus is provided by fluidized bed devices in which a mass of coating powder is fluidized by passage of a gas therethrough. Generally, such equipment has a horizontally disposed plate or membrane for support of the powder, and air is charged through the plate from an underlying plenum. The particles are electrostatically charged by passage proximate to an electrode, which is usually mounted adjacent the porous plate and is connected to a high voltage D.C. source. Apparatus of this type is commercially available from Electrostatic Equipment Corporation, of New Haven, Conn.

Although such devices are in widespread use for numerous applications, their full potential has not heretofore been realized. A significant deterrant to wider utilization has been the inherent hazard presented by the high voltage charging means. Thus, the possibility of arcing occurring between the electrode and the workpiece or to personnel in the vicinity, with the consequent threats of fire and electrical shock that are presented, has not only limited acceptance, but has also frequently imposed undue design restrictions. To a lesser extent, the conventional electrode arrangement has itself imposed limitations upon design flexibility.

Attempts have been made to provide less dangerous electrostatic fluidized bed equipment, exemplary of which is the device described in Sargent U.S. Pat. No. 3,670,699, wherein a gas transmissive web of moderate conductivity is disposed in the gas path, so that the gas may be employed to carry electrical charges to the fluidized particles. Although devices of the sort described by Sargent may offer some advantages, their charging efficiency tends to be inadequate and to vary with changing ambient conditions (such as humidity) and, moreover, they are found to afford a generally inadequate measure of safety.

Accordingly, it is an object of the present invention to provide novel electrostatic fluidized bed apparatus that is highly safe to operate.

It is also an object of the invention to provide such apparatus, which is capable of efficiently, reliably and uniformly charging particulate materials.

Another object is to provide such apparatus in which a high degree of design flexibility is afforded.

A further object of the invention is to provide a novel method for electrostatic coating, which is highly safe.

A still further object is to provide a novel method whereby particulate materials can be electrostatically charged efficiently, reliably and uniformly.

SUMMARY OF THE DISCLOSURE

It has now been found that certain of the foregoing and related objects of the invention are readily attained in electrostatic coating apparatus that includes a housing, in which is defined a fluidization chamber above a porous support member mounted therein, and a plenum therebelow. The apparatus also includes high efficiency gas ionizing means, that is so disposed as to furnish to the plenum highly ionized gas, and that is spaced from the support member by a minimum distance of about 7.5 centimeters, as measured along the most direct gas flow path defined therebetween. The resultant configuration of the apparatus causes ionized gas from the ionizing means to pass from the plenum through the support member and into the fluidization chamber, to fluidize and efficiently electrostatically charge particulate material supplied thereto. The minimum spacing effectively isolates the ionizing means, and thereby avoids, under normal operating conditions, the passage therefrom of a substantial current to an effectively oppositely charged member disposed in the fluidization chamber.

Preferably, the gas ionizing means comprises a porous metal electrode that has maximum resistance value of about 0.05 ohm per centimeter (as measured with a 2.5 centimeter separation between the meter probes). Most desirably, the electrode will be provided as a porous mat of sharp-edged fibers, and the fibers thereof may either or randomly disposed or woven in a uniform pattern. A metal wool mat will provide an excellent electrode of the former type, and in the latter type of electrode the fibers are typically of flattened wire having a width of not greater than about 0.05 centimeter. Moreover, while virtually any highly conductive ferrous or non-ferrous metal may be employed in the electrode, in the preferred embodiments it will be fabricated from iron, brass or aluminum, or from an alloy based upon one of those metals, and the electrode will have a maximum resistance value of about 0.005 ohm per centimeter; in most instances, the resistance value will be even lower.

Optimal operation will generally result when the ionizing means and support member are spaced a minimum distance of 25 centimeters from one another, and when the ionizing means is so disposed as to cause substantially the entire volume of ionized gas which it produced to pass through the support member; the ionizing means may conveniently be mounted within the plenum of the housing. Preferably, the plenum comprises an inner compartment adjacent the support member and an outer compartment which is separated from the inner compartment by the ionizing means, with the compartments communicating with one another therethrough. In such a case, the housing may have a gas inlet opening which communicates with the outer compartment, and which has a cross sectional area that is substantially smaller than the area over which the outer compartment communicates with the ionizing means. The outer compartment thereby effects a decrease in velocity of gas introduced through the inlet opening, as well as a better distribution of the gas to the ionizing means. Ideally, in such an embodiment the ionizing means and the plenum compartments will be cooperatively dimensioned, configured and disposed so as to maximize exposure, to the charging elements of the ionizing means, of gas passed therethrough from the outer to the inner compartment. It will generally be necessary to ensure that at least the major portion of the gas flow path between the ionizing means and the support member is free from severe deionization structure, and more specifically, free from structure having the deionization equivalent of a cylindrical tubular member with a length to diameter ratio greater than about 1.5:1.0.

Certain objects of the invention are attained by the provision of electrostatic coating apparatus comprising the combination of a housing having the features hereinbefore defined, and a porous electrode comprised of sharp-edged metal fibers and having a maximum resistance value of about 0.05 ohm per centimeter. The electrode thereof is mounted in a gas flow conduit defined at least in part by the plenum within the housing, so as to ensure that the major portion of gas flowing through the conduit passes through the electrode, and it is spaced from the support member by a minimum distance of at least about 7.5 centimeters, as measured along the most direct gas flow path defined therebetween. The electrode must also be adapted to receive a high voltage charge to enable the efficient ionization of gas passed therethrough. Preferably, in such apparatus the lower extremity of the plenum is defined by a floor extending thereacross, and the mat of metal fibers, that is desirably employed as the ionizing means, extends across the plenum as a layer supported upon the floor. The plenum may be further defined by a sidewall extending upwardly from adjacent the floor, with either the floor or the sidewall, or both, defining openings for gas flow into the plenum. The openings should be disposed relative to the mat of metal fibers so as to ensure passage therethrough of at least the major portion of gas entering the plenum. Most desirably, in apparatus of the type described the housing has a sidewall and a bottom wall spaced, respectively, from the sidewall and floor of the plenum, to thereby enclose the plenum therewithin and to cooperatively define an outer plenum thereabout. In such a case, the disposition of the metal fiber mat and the area for gas flow provided by the openings should be such as to ensure that gas entering the first-mentioned plenum from the outer plenum passes through substantially the entire volume of the mat, thereby obtaining the maximum utilization thereof for gas ionization.

The conduit provided in apparatus of the sort hereinabove described may include a section of reduced cross sectional dimensions which opens into the plenum, with the electrode employed therein advantageously consisting of a mat of metal fibers disposed within the conduit section referred to. Generally, such a conduit section will be provided as a gas pipe connected to the housing.

In other embodiments, the housing of the apparatus is provided with apertures that are adapted to permit objects of extended length to be drawn through the fluidization chamber thereof. In those embodiments, the porous support member may also have an aperture that is adapted to permit such objects to be drawn therethrough, vertically of the housing. Moreover, such apparatus desirably additionally includes a hollow insulating member that is vertically disposed in the plenum and is adapted for the passage therethrough of the extended length objects; the insulating member serves to prevent electrical discharge to the object from the electrode.

In still other embodiments of the invention, apparatus is provided which includes a housing having the features described; high efficiency gas ionizing means, which is spaced from the support member and is so disposed as to furnish to the plenum highly ionized gas; and baffle means that is fabricated from an insulating material and is interposed in the gas flow path between the ionizing means and the support member. The baffle serves to shield the ionizing means, and to increase the effective length of the gas flow path; it thereby cooperates to effectively isolate the ionizing means. In such apparatus, the ionizing means will generally include a metal electrode having a maximum resistance value of about 0.05 ohm per centimeter, and having elements extending aross a lower portion of the plenum, with the baffle means comprising a planar member extending across the plenum above the electrode. The baffle means will have a larger area than is provided by the upper effective surface of the electrode, so that it masks the electrode from the support member and provides the shielding and path-lengthening effects which are desired.

In still further embodiments, the electrostatic coating apparatus comprises a housing, and high efficiency gas ionizing means which conforms to the foregoing description, but which differs therefrom by virtue of having a removable porous support member mounted in the housing. Preferably, the housing of such apparatus has an upwardly extending sidewall, and the support member is generally planar, the latter having a peripheral configuration that conforms substantially to the internal cross sectional configuration of the corresponding portion of the sidewall, and thus permits the support member to be snugly seated therewithin. The support member may also have a peripheral sidewall that extends upwardly continuously thereabout, so that the support member and the peripheral sidewall together provide a tray that is removably seated within the housing.

Certain objects of the invention are attained by the electrostatic coating method that is herein set forth. Broadly, the method includes the steps of: generating a stream of highly ionized gas at a location spaced by at least a minimum discharge distance from a porous support member; supplying to the upper surface of the support member particulate material that is capable of acquiring an electrostatic charge; passing the highly ionized gas along a flow path and thereafter upwardly through the support member, while substantially maintaining the ionization level thereof, to fluidize and efficiently electrostatically charge the particles of the material to thereby produce a fluidized bed thereof; and placing in proximity to the fluidized bed a workpiece having a charge effectively opposite to the particles, to thereby produce a coating thereof upon the workpiece. The minimum discharge distance must be such as to prevent the passage of a substantial current from the source of the ionized gas to an electrically grounded member placed upon the upper surface of the support member, and in preferred embodiments of the method the minimum discharge distance is about 25 centimeters.

The method may be practiced by including the step of passing a gas through a porous mat of sharp-edged metal fibers, at a velocity of about 3.0 to 15.0 standard cubic feet per minute, while applying to the mat a voltage of about 30 to 80 kilovolts, to thereby generate the stream of highly ionized gas. In some instances, the method is advantageously carried out by placing the workpiece within the fluidized bed of particulate material to produce the coating thereon. More specifically, the rate of flow of ionized gas through the particulate material may be controlled to produce in the fluidized bed a discernible lower dense phase and a less dense phase thereabove, with the workpiece being placed within the dense phase for coating. Additional variation in the practice of the method may involve passing the ionized gas to the support member in a direction that is generally vertical, but that includes horizontal components, which will thereby increase the length of the gas flow path. Finally, in carrying out the method, an object of extended length may be used as the workpiece, with the step of placing the workpiece in proximity to the fluidized bed being effected by drawing the object upwardly therethrough.

DETAILED DESCRIPTION OF THE ILLUSTRATED EMBODIMENTS

Figure 1:
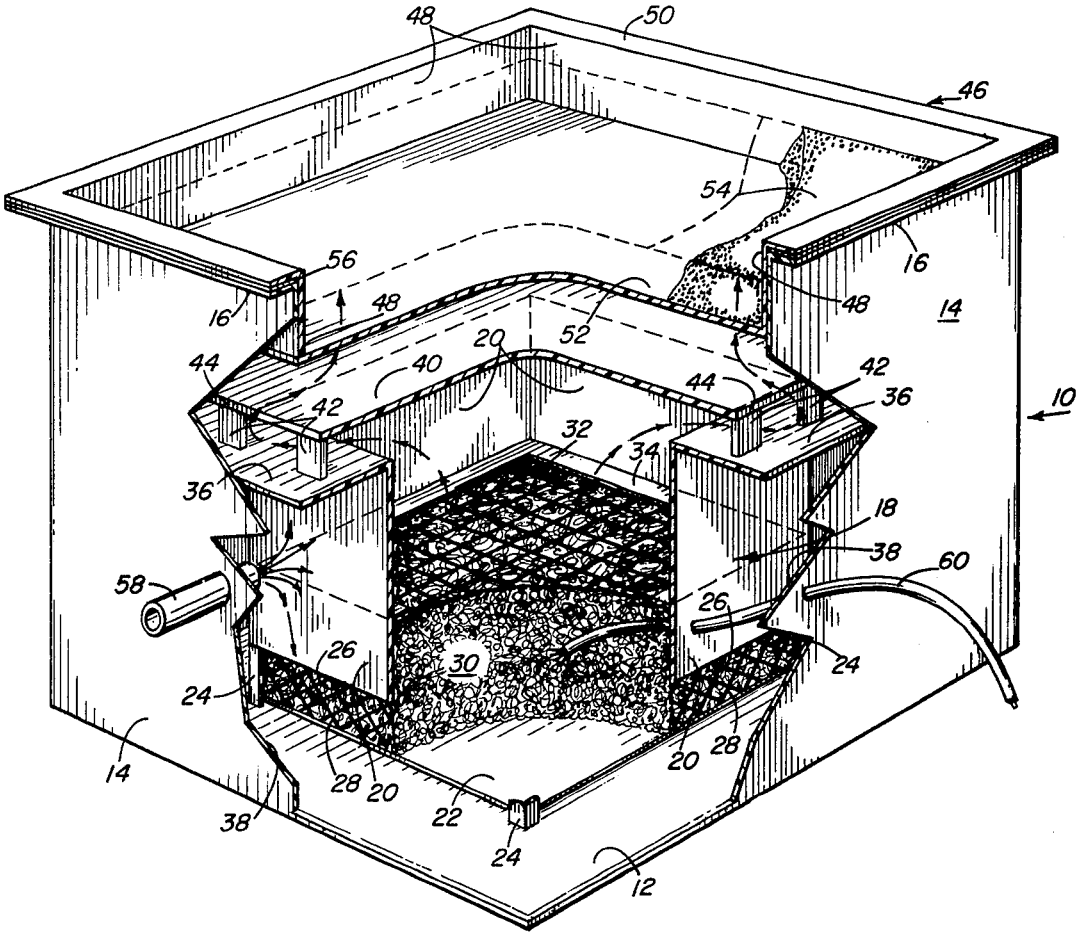
FIG. 1 is an isometric view of electrostatic fluidized bed apparatus embodying the present invention, in partial section and with portions broken away to expose internal structure thereof.

Turning now in detail to FIG. 1 of the appended drawings, therein illustrated is an electrostatic fluidized bed apparatus embodying the invention hereof and including a housing, generally designated by the numeral 10. The housing 10 is comprised of a rectangular bottom wall 12 and sidewalls 14 extending upwardly therefrom and terminating in outwardly extending upper peripheral flange 16. Within the housing 10 is an electrode basket, generally designated by the numeral 18, consisting of sidewalls 20 which are secured to a rectangular bottom wall 22 by short corner posts 24. The sidewalls 20 terminate short of the bottom wall 22, and thereby define elongated slots 26 extending about the periphery of the basket 18 adjacent the bottom wall 22 thereof. A grid or lattice work screen 28 is secured over each of the slots 26 to restrain lateral displacement therethrough of the electrode 30, which is provided as a metal wool mat supported upon the bottom wall 22. An upper grid 32 spans the basket 18, and is secured over the electrode 30 by engagement under the inwardly extending peripheral flange 34, thereby preventing upward displacement of the electrode 30 and retaining it within the bottom portion of the basket 18.

A relatively wide peripheral flange 36 extends outwardly from the upper edges of the sidewalls 20 and into sealing contact with the corresponding sidewalls 14 of the housing 10, thereby defining, in cooperation with the bottom walls 12, 22, an outer plenum 38. It will be appreciated that an inner plenum is defined within the basket 18, and that the electrode 30 is effectively interposed therebetween. The flange 36 also serves to support, on its upper surface, the rectangular baffle 40, which is provided with short depending legs 42 for that purpose. It will be noted that the baffle 40 is larger in cross sectional area than is the plenum defined within the basket 18, and that its marginal edges 44 lie inwardly from the walls 14 of the housing 10. The baffle 40 therefore serves to direct gas flow outwardly, and thereby to lengthen its flow path by the introduction of generally horizontal components thereinto.

A tray, generally designated 46, is removably seated within the open top of the housing 10, and comprises sidewalls 48 having a peripheral flange 50 extending outwardly from the upper edges thereof, and a porous bottom wall or floor 52 secured to the lower edges of the sidewalls 48. A mass of coating powder 54 is contained within the tray 46, and a layer 56 of gasket material is interposed between the coextensive flanges 16, 50 of the housing 10 and tray 46, respectively, to afford a gas tight seal therebetween. A section of the gas pipe 58 extends through one of the sidewalls 14, and a length of electrical cable 60 passes through walls 14 and 20 for interconnection to the electrode 30. The pipe 58 and cable 60 are attached respectively to appropriate gas and electrical supply sources, neither of which is illustrated.

As will be apparent, in operation of the apparatus of FIG. 1, voltage is applied to the electrode 30 through the cable 60, and gas (normally air) is passed through pipe 58 into the outer plenum 38, whereupon its velocity diminishes greatly due to the large increase in the area for gas flow that the plenum 38 provides. The plenum 38 also distributes the gas about the electrode basket 18, and causes it to flow uniformly through the slots 26 and into and through the electrode 30. The slots 26 expose a large surface area of the electrode 30 to the gas, thus affording maximum utilization of the available charging sites provided by the electrode 30, and thereby most efficiently ionizing the gas passing therethrough. The gas flowing upwardly through the plenum of basket 18 is diverted outwardly by the baffle 40, whereupon it flows upwardly about its edges 44 and then inwardly and upwardly through the porous floor 52. Percolation of the ionized gas through the particulate material 54 simultaneously fluidizes it and imparts an electrostatic charge to the particles thereof. As will be appreciated, placing a grounded object or workpiece into proximity with the thus charged and fluidized material 54 (i.e., the fluidized bed) will cause the particles thereof to deposit on and adhere to the object, and to produce a coating thereon.

Figure 2:
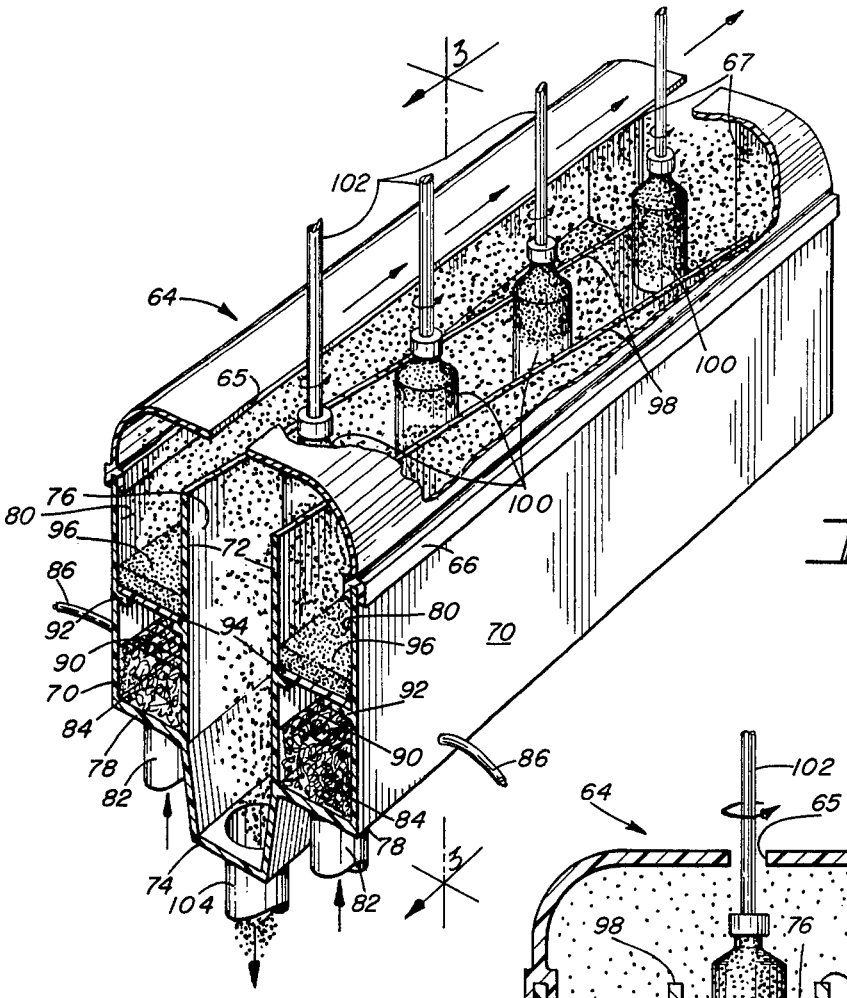
FIG. 2 is an isometric view of a second embodiment of the invention, having a forward section removed and a cover portion broken away to expose internal structure thereof.
Figure 3:
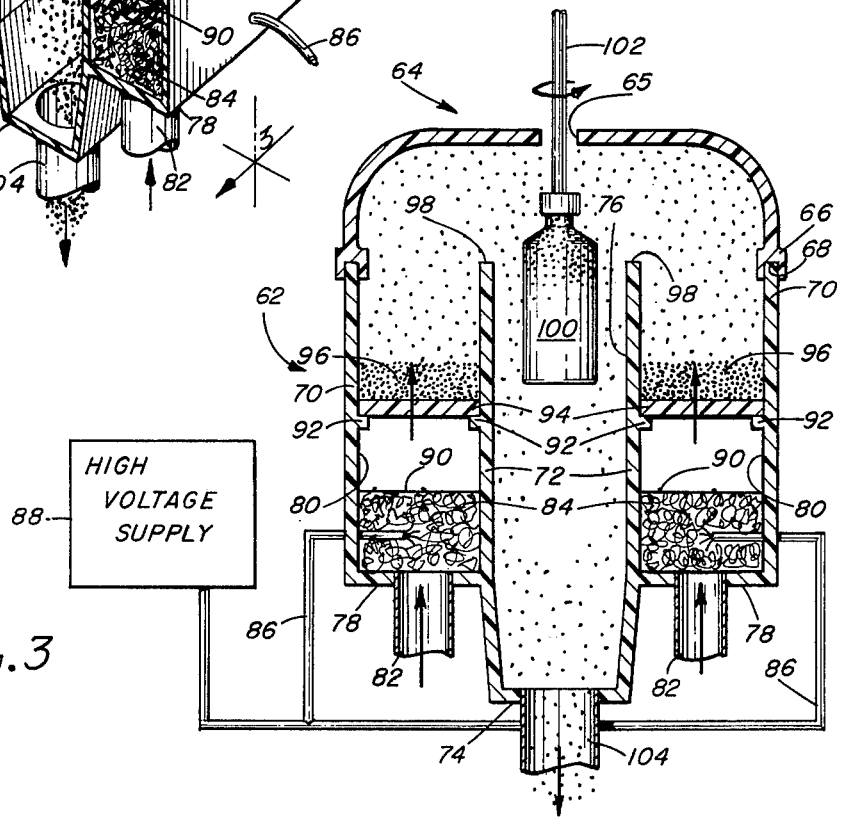
FIG. 3 is a cross sectional view along line 3-3 of FIG. 2, drawn to a slightly enlarged scale and having the voltage supply added thereto.

Turning now in detail to FIGS. 2 and 3, apparatus is illustrated which embodies the instant invention, and which is particularly adapted for the continuous coating of a succession of articles of appreciable axial length, such as the containers 100 that are shown. The apparatus comprises a base, generally designated 62, and a cover, generally designated 64, the latter having end walls 67 and enlarged lower marginal edges 66. The edges 66 define inverted U-shaped channels 68, which receive therein the upper edges of the sidewalls 70 of the base 62. The base 62 has a pair of upstanding, parallel baffles 72 which, in cooperation with the bottom wall portion 74, define an elongated central trough 76 running along the entire length of the base 62. An additional bottom wall portion 78 extends laterally to either side of the trough 76 at an elevation somewhat above the wall portion 74; the wall portions 78, together with the corresponding sidewalls 70 and baffles 72, define a pair of parallel, elongated lateral compartments 80.

A duct 82 is connected to the bottom wall portion 78 of each compartment 80, for the purpose of introducing air or other gas thereinto. The bottom of each compartment 80 is lined with a layer 84 of metal wool, which in turn is connected by an electrical cable 86 to the high voltage supply 88, to thereby constitute the metal wool layers 84 as effective electrodes. The layers 84 are restrained against upward displacement by the wire grids 90 (secured within the compartments 80 by means not shown), and peripheral flanges 92 project inwardly about the compartments 80 at a location spaced above the grids 90. A porous plate 94 is supported upon each flange 92, thereby dividing the compartments 80 into plenums below the plates 94 and fluidization chambers thereabove.

In operation, the layers 84 of metal wool are charged with high voltage, and gas is introduced through the ducts 82. The gas distributes through the layers 84 and becomes ionized by the corona discharge occuring thereabout. As in the previously described specific embodiment, the gas passes upwardly through the plenums and through the plates 94 to fluidize and electrostatically charge the particles of the material 96 that is supplied thereto; thus, an electrostatic fluidized bed is defined along each side of the length of the trough 76.

Individual articles 100 are supported upon appropriate (normally grounded) spindles 102, and are conveyed (in the direction indicated by the arrows in FIG. 2) while so supported through the trough 76, with the spindles 102 passing through the slot 65 defined by the inner edges of the cover 64. Since, as can best be seen in FIG. 2, the baffles have upper edges 98 which slope downwardly in the direction of forward movement, the sidewall portions of the objects 100 become progressively exposed, from top to bottom, therebehind, producing uniform deposits thereon. Undeposited material 96 falls downwardly through the trough 76, and is removed therefrom by vacuum drawn through the outlet conduit 104, for direct recycle or for delivery to a suitable reservoir (not shown).

Figure 4:
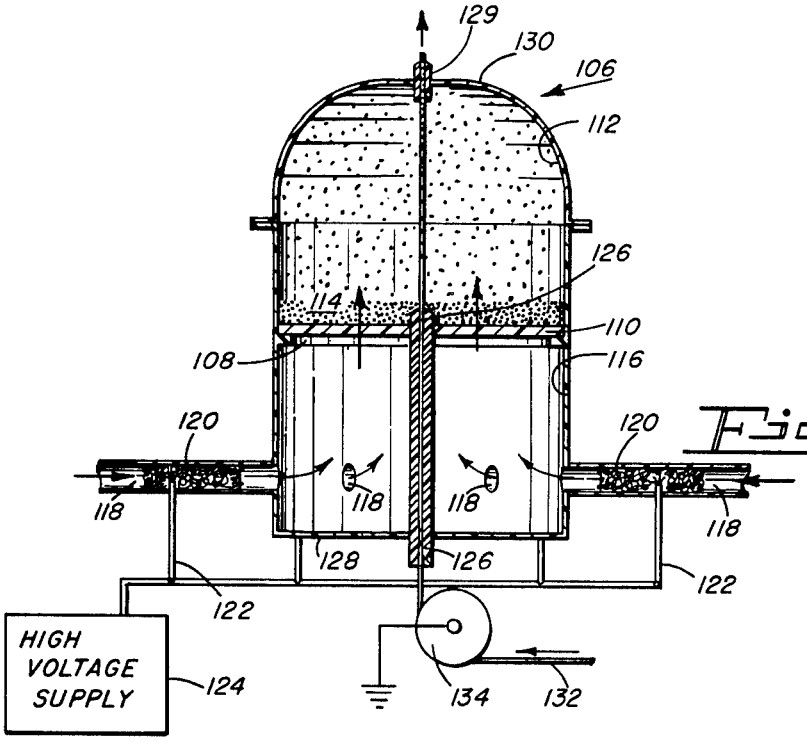
FIG. 4 is a vertical sectional view of another embodiment of the invention, the device shown being particularly adapted for wire or strip coating.

The embodiment of FIG. 4 exemplifies apparatus that is suitable for coating objects of extended (or virtually continuous) length, such as wire, strips of metal or other material, etc. The housing, generally designated 106, is provided with an inwardly projecting peripheral ledge or flange 108, upon which is supported a porous plate 110, which divides the housing 106 into an upper fluidization chamber 112 containing the coating powder (particulate material) 114, and a lower plenum 116. A plurality of radially extending pipes 118 surround the housing 106 (which may appropriately be of circular cross section) and open into the plenum 116. A plug 120 of metal wool is retained by appropriate means within, and near the outlet end of, each of the pipes 118, and the plugs 120 are connected by a suitable cable 122 to the high voltage supply 124; it will be appreciated that the opposite end of each pipe 118 is connected to a gas supply, which is not illustrated. A hollow core 126 extends vertically through the plenum 116 between the porous plate 110 and the bottom wall 128 of the housing 106, and guide tube 129 is mounted in cover portion 130 in axial alignment therewith.

In operation, the extended-length workpiece 132 (wire in this instance) is drawn about the grounded pulley 134, and through the core 126 and tube 129, whereby it passes vertically through the fluidization chamber 112. In a manner similar to that previously discussed with reference to earlier embodiments, gas introduced through the pipes 118 is ionized during passage through the metal wool plugs 120, and serves the dual function of fluidizing an electrostatically charging the particles of the powder 114, which in turn coat the workpiece 132 during its travel through chamber 112. Both the core 126 and also the tube 129 serve sealing functions; however, the core 126 also serves to insulate the workpiece 132 against arcing during its passage through the plenum 116.

Figure 5:
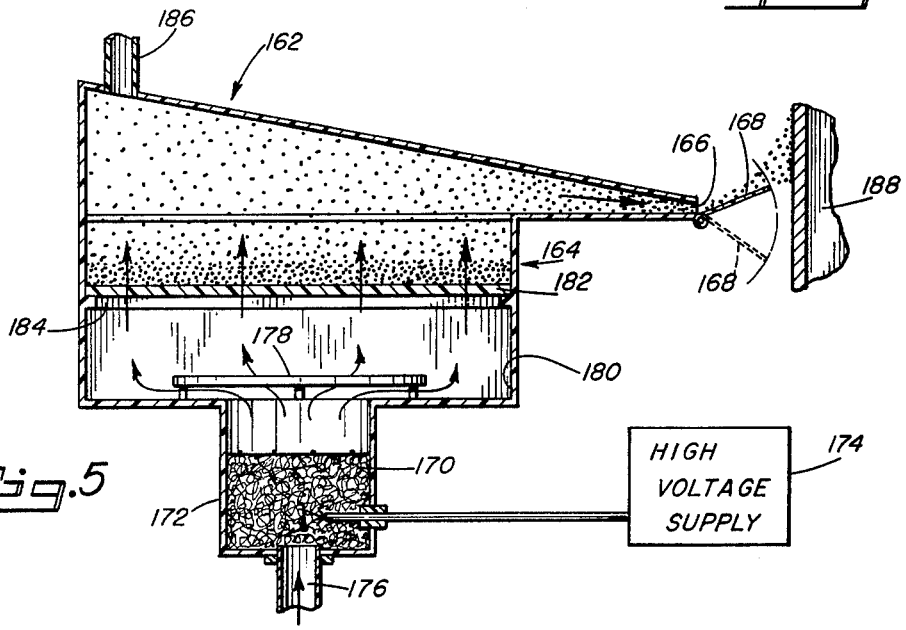
FIG. 5 is a vertical sectional view of yet another embodiment of the invention, wherein means for directing the flow of coating powder is provided.

Turning now to FIG. 5, the unit illustrated is similar in nature to the apparatus hereinbefore described, but includes a flow-directing hood portion, generally designated 162, overlying the base, which is generally designated 164. As will be noted, the hood 162 has a cross sectional configuration that tapers to a narrow (normally elongated in the direction perpendicular to the plane of the drawing) outlet slot 166, on which is hingedly mounted a flow directing plate 168.

The metal wool electrode 170 contained within the lower plenum compartment 172 is charged to a high potential from the voltage supply 174, and gas is injected thereinto through the conduit 176. The thus ionized gas proceeds upwardly about the baffle plate 178, into the plenum compartment 180, and through the porous plate 182, which is supported upon the ledge 184. Particles of the electrostatic fluidized bed, produced from a suitable particulate material supplied through the feed tube 186, eventually pass outwardly through the slot 166, and are directed by movement of the hinged plate 168 (as suggested by the phantom line representation) to various portions of the workpiece 188. As will be appreciated, the plate 168 may be reciprocated or held in a stationary position during operation, and the workpiece 188 may be held stationary or moved (with or without movement of the plate 168) to produce desired effects.

Figure 6:
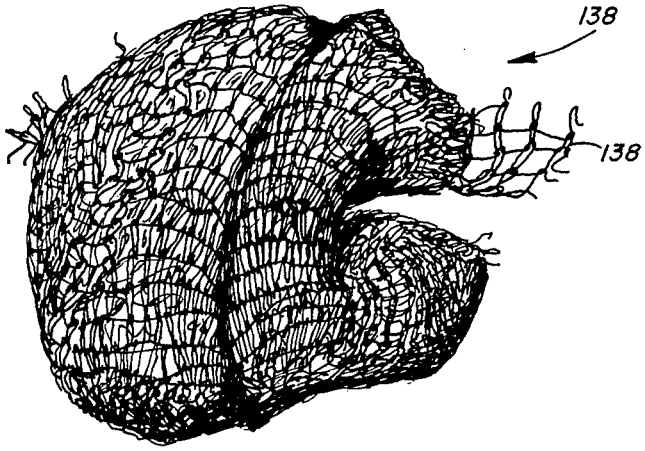
FIG. 6 is a section of a woven metal web that is suitable for use as the electrode in the apparatus hereof.

Finally, FIG. 6 shows a section of web, generally designated 136, which is woven from monofilament strands 138. Such a web is suitable as the electrode in the apparatus of the invention, in place of the random metal wool mats illustrated in the foregoing figures.

Illustrative of the efficacy of the present invention is the following specific example:

EXAMPLE

A device embodying the concepts of the invention (A) was constructed and compared in operation with electrostatic coating units of the prior art. The device of the invention had a porous plate of polyethylene defining the underlying plenum and the overlying fluidization chamber, and it had an electrode, covering approximately the same area, spaced below the porous plate by a distance of about 28 centimeters. A baffle of the type shown in FIG. 1 was positioned about 7.5 centimeters below the porous plate, and had the effect of lengthening the flow path between the porous plate and the electrode to about 35 centimeters. The electrode was provided by a mat of woven strands of flattened copper wire, about 0.01 centimeter in thickness and about 0.05 centimeter in width, weighing about 1.27 grams per meter, and exhibiting a resistance of about 0.004 ohm per centimeter, as determined with a 2.5 centimeter separation between the probes of a Simpson meter. The electrode was interposed in the gas flow path between the air inlet and the porous plate, and was disposed so that substantially all of the air introduced into the plenum necessarily passed therethrough.

A first prior art unit (B) was constructed similarly to device (A) described above, except that a piece of galvanized steel, expanded metal "walk plate", placed on top of the porous plate, was used as the electrode, and the baffle below the porous plate was omitted. In a second prior art unit (C) the electrode was provided by a thin carbonaceous layer produced by coating and drying, upon the underside of a polyethylene porous plate, a dispersion of graphite particles.

In one part of a series of comparative tests conducted with the foregoing devices (A), (B) and (C), a clean, square steel plate, measuring about 5 centimeters on a side and about 0.16 centimeter in thickness, was connected to a vacuum tube volt meter to provide a test plate. The test plate was secured to a plastic rod which was mounted, in turn, to dispose the plate for height adjustment above the porous plate of the unit being tested, and with the test plate and porous plate in substantially parallel planes. By measuring the test plate voltage at various applied electrode voltages, the amounts of current drawn at different distances above the porous plate were calculated (since the air resistance was constant and relatively small, compared to the resistance of the voltage meter, it was ignored for the purpose of these calculations).

Table One, which follows, sets forth the data so obtained. As indicated, the power to the electrode is expressed in kilovolts (KV), the current values calculated are in microamperes, and the spacing is the approximate distance, in centimeters (cm), between the upper surface of the porous plate and the lower surface of the test plate, at which the reported test plate readings were taken.

TABLE ONE

| Voltage Applied (KV) | Current (Microamps) Unit A | Unit B | Unit C | Spacing (cm) | Current (Microamps) Unit A | Unit B | Unit C | Spacing (cm) |
|---|---|---|---|---|---|---|---|---|
| 30 | — | — | short | zero | — | — | 1.2 | 10 |
| 40 | 0.005 | short | | " | 0.000 | 34 | 7.5 | " |
| 50 | 0.02 | | | " | 0.000 | 60 | 22.5 | " |
| 60 | 1.6 | | | " | 0.000 | 126 | 27 | " |
| 70 | 3.0 | | | " | 0.004 | short | | " |
| 80 | 4.0 | | | " | 1.2 | | | " |
| 30 | — | — | 35 | 2.5 | — | — | 0.19 | 12.5 |
| 40 | 0.000 | short | 90 | " | 0.000 | 11 | 3.8 | " |
| 50 | 0.000 | | short | " | 0.000 | 38 | 12.2 | " |
| 60 | 0.04 | | | " | 0.000 | 59 | 14 | " |
| 70 | 0.2 | | | " | 0.58 | short | | " |
| 80 | 0.8 | | | " | 1.2 | | | " |
| 30 | — | — | 13 | 5 | — | — | 0.14 | 15 |
| 40 | 0.000 | short | 49 | " | 0.000 | 0.035 | 2.2 | " |
| 50 | 0.000 | | 75 | " | 0.000 | 13.5 | 3.5 | " |
| 60 | 0.02 | | 126 | " | 0.000 | 34 | 8 | " |
| 70 | 0.35 | | | " | 0.000 | — | | " |
| 80 | 1.4 | | | " | 2.0 | — | | " |
| 30 | — | — | 4.6 | 7.5 | | | | |
| 40 | 0.000 | short | 21 | " | | | | |
| 50 | 0.000 | | 43.5 | " | | | | |
| 60 | 0.02 | | 64 | " | | | | |
| 70 | 0.06 | | | " | | | | |
| 80 | 1.05 | | | " | | | | |

As will be appreciated, the indication of a "short" means that electrical discharge occurred under the conditions specified, and that such conditions were hazardous; usually, the maximum safe current drain will be about 130 microamps. Notwithstanding the notable safety of the device (A) of the invention, as evidenced by a current drain of only 4.0 microamps under the most dangerous conditions employed (i.e., 80 kilovolts applied, with the test plate resting upon the porous plate), there is no sacrifice in performance. Indeed, under most conditions better results are obtained with the unit (A) than with either unit (B) or unit (C).

Thus, in a second part of this Example, tests were conducted using an air flow rate that was optimum for the particular unit (and was from about 4 to 6 standard cubic feet per minute, per square foot of area of the porous plate), and using a conventional epoxy coating powder to coat the above-described test plate, which was grounded and placed at a distance of about 10 centimeters above the porous plate of the unit. Before each test, the plate was freed of powder, thoroughly cleaned with trichloroethylene followed by acetone, and finally dried with a lint-free wipe. Table Two below sets forth the weight of powder (in grams) that was deposited on the test plate by each unit, with the exposure times (in seconds) and applied electrode voltages (in kilovolts) as specified.

TABLE TWO

| Time (sec.) | VOLTAGE APPLIED (KV) 40 POWDER DEPOSITED (g.) A | B | C | 50 A | B | C | 60 A | B | C |
|---|---|---|---|---|---|---|---|---|---|
| 2 | 0.8 | 0.8 | 3.2 | 4.2 | 0.3 | 4.8 | 5.2 | 1.6 | 5.8 |
| 4 | 3.1 | 1.3 | 5.8 | 8.0 | — | 6.6 | 7.4 | — | 5.5 |
| 6 | 5.4 | 2.0 | 6.7 | 7.4 | 2.6 | 5.7 | 8.2 | 5.1 | 5.4 |
| 8 | 7.2 | 1.4 | 6.2 | 7.8 | 2.5 | 5.5 | 8.7 | 3.8 | 4.8 |
| 10 | 9.5 | 2.2 | 6.0 | 7.5 | 2.7 | 4.8 | 9.7 | 5.3 | 4.9 |
| 12 | 8.7 | 1.7 | — | — | 5.0 | — | 8.0 | 4.4 | — |

As can be seen, in most instances the efficiency of the unit embodying the invention (A) was higher than that of either of the other two devices, (B) or (C). All of the tests of the Example were carried out under ambient temperature and humidity conditions.

While virtually any device that is capable of producing a stream of highly ionized gas may be employed in the practice of the invention, excellent results are attained with devices that employ highly conductive metal elements to provide a gas-charging electrode. To be satisfactory, such an electrode should exhibit a miximum resistance of about 0.05 ohm per centimeter (as measured over a distance of about 2.5 centimeters on the electrode surface); preferably, the resistance will not exceed 0.005 ohm per centimeter, and usually it will be considerably lower. While such electrode elements may be ferrous or non-ferrous, and may be of noble metals such as gold, silver, platinum, and the like, as a practical matter they will most often be made of iron, copper, or aluminum, or of an alloy based upon one of those metals. Although the form or configuration of the electrode elements is not critical, most satisfactory results have been achieved by the use of electrodes comprised of porous mats of sharp-edged fibers, with highly effective electrodes being provided by the materials commonly known as metal wool (e.g. steel wool) and fine flattened wire cleaning meash (e.g. of copper). Typically, metal wool is a random, entangled mass of fine metal fibers in which the fibers weigh about 0.02 gram per meter, and containing about 99 percent free space; the fibers of the wire cleaning mesh are normally woven in a uniform pattern and weigh about two grams per meter, and the mesh contains about 98 percent free space. It is believed that the outstanding effectiveness of this type of electrode, in the practice of the invention, is due largely to the multitude of highly efficient charging sites that are provided by the extensive length of the fibers, coupled with the excellent distributional effect and intimacy of gas contact afforded by their particulary porosity characteristics. It should be appreciated that, even when woven mats of fibers are employed herein, they will usually be folded or wadded so as to define a tortuous path for gas flow therethrough, since such a path will tend to maximize charging efficiency and gas distribution. It might also be mentioned that the weight per unit length data set forth above are indictive of the fineness of the metal electrode elements that may advantageously be used herein, nd the volumetric percentages of free space (which will normally exceed 95 percent) indicate desirable levels of porosity.

As seen in the drawings, the ionizing means may be located within a plenum of the fluidized bed apparatus, or in a pipe or other conduit leading thereto. The important factor, with respect to placement of the ionizing means (and more generally the charging elements thereof), involves its spacing from the porous support member, since that member will normally constitute the point of closest approach to the ionizing device, and hence the limit of safety. Thus, the hazardous nature of conventional electrostatic apparatus resides largely in the danger of shock, fire or burn from an electrical discharge between the high voltage electrode elements and personnel or objects in the vicinity. Since the greatest danger normally exists in the zone above the porous support member (that being where coating occurs, and other parts of the apparatus being readily grounded and shielded or insulated), separating the voltage-carrying elements from the support member by a minimum discharge or arcing distance prevents closer approach to those elements, by rendering the support member an effective physical barrier, and thereby affords a significant measure of protection. If the distance of separation is such that, with the normal operating voltage applied to the charging elements, little current (i.e., less than about 130 microamperes) would be drawn to a grounded object placed upon the porous support member, the possibility of shock or discharge would be very low or non-existent, and the apparatus would be virtually hazard-free (of course, the precise value of the minimum current that is necessary for discharge will depend somewhat upon the nature of the grounded object, such as the presence of sharp edges thereon, etc.). Under practical operating conditions (i.e., an air flow rate of about 3 to 25, and preferably about 4 to 15, SCFM/square foot of porous plate, and an applied electrode voltage of about 30 to 80, and preferably about 40 to 60 kilovolts), the typical unit of the invention (wherein the gas flow path distance between the ionizing means and the porous plate is about 7.5 to 75, and preferably about 25 to 50, centimeters) will produce a maximum current of about5 microamps in a flat grounded object placed directly upon the upper surface of the porous plate. It should be appreciated that, whereas 7.5 centimeters will generally be the minimum safe flow path distance under practical operating conditions (i.e., the distance over which arcing will not occur), the maximum flow path distance will be solely dependent upon the achievement of desired results.

Although the theory underlying the safe and yet efficient operation that is possible in accordance with the instant invention is not fully understood, it is believed to be due to the utilization of highly ionized gas as the charging and fluidization medium. While such gas is an effective carrier of electrical charges, the voltage developed therein, and hence its discharging potential, is relatively low, as compared to a high voltage metal electrode, per se. Consequently, in accordance with this invention the ionized gas is used to efficiently charge particles of the coating material, without undue risk or danger.

It should be appreciated that the separation between the porous plate and the electrode (or other ionizing means), or the "minimum discharge distance", is measured along the most direct gas flow path therebetween (assuming, of course, that the flow path is defined by dielectric materials). Thus, notwithstanding that the vertical separation between the porous support member and electrode may be less than the safe minimum, interposition of an insulating baffle may be relied upon to lengthen the gas flow path, and thereby the electrical arcing distance, to such an extent that safety is afforded. This principle is illustrated in FIGS. 1 and 5 of the drawings; as will be appreciated, it may be embodied in many different forms of baffles, plates, shields, and the like, which serve to define a tortuous rather than direct path to the porous support member.

It is also important that the gas flow path be substantially free from severe deionizing or charge-dissipating, structure. Generally, some degree of deionization will occur in the apparatus, particularly upon passage of the gas through the porous support member, which is one reason why a highly ionized gas must be generated initially. However, undue deionization structure in the portion of the flow path between the ionizing device and the porous plate can render the apparatus virtually ineffectual, and so should be avoided. Specifically, it is known that a cylindrical member having a length that is more than one and one-half times its diameter will severely deionize an ionized gas passed therethrough; accordingly, such members (and members of equivalent deionizing effect) should not be present in that portion of the flow path, or at least they should not be present in such quantity or disposition that the major portion of the gas passing therealong must pass therethrough.

As seen in the drawings, the housings for the apparatus of the invention may take a wide variety of forms, and it will be appreciated that those specifically shown are merely illustrative, and not limiting. Variations will be apparent to those skilled in the art, which by-and-large will depend upon the specific application for which the equipment is intended. Nevertheless, certain features of the plenums defined therein are believed to be quite unique, and such plenum designs do contribute significantly to operation of the apparatus in several preferred embodiments. Thus, the provision of inner and outer plenum compartments, between which (in relation to the gas flow path) the ionizing means is interposed, permits the use of ionizing means having an extended surface area, while ensuring effective distribution of the gas thereto and while also making maximum use of the charging sites available thereon. These benefits are obtained, in general, by exposing the elements of the ionizing means (especially, of a fibrous metal mass) as fully as possible to the stream of gas, which is readily achieved in a compartmented plenum of the type illustrated. A further desirable feature of the preferred plenums hereof derives from the enlargement of the flow path cross section that they provide, at a location upstream of the ionizing means. Such enlargement decreases the velocity of the gas supplied to the ionizing means, and thereby enhances the uniformity of distribution therethrough and increases the intimacy of contact with the charging sites thereof, which in turn provides the generation of a highly ionized gaseous stream.

As shown in FIG. 1, the use of spaced ionizing means renders it feasible to enjoy a removable porous support member which, in turn, affords other advantages; generally, in prior art electrostatic fluidized bed apparatus the charging means is incorporated in, or at least supported by, the porous support member, thus precluding the facile removal of the support member. In the instant apparatus, the removability of the porous support member permits it to constitute the floor of a tray, which may be readily replaced with a similar tray containing a coating powder of different composition, color, etc.; thus, powder changes may be made quickly and without contamination. Moreover, by providing trays of various depths, the spacing of the support member from the ionizing means can readily be altered, as may be desirable to permit optimum operation at different voltages, or to otherwise vary the operating conditions or characteristics. Although not illustrated, the ionizing means may itself be adjustably mounted to afford the same advantages; similarly, by charging only selected ones of the electrode plugs 120 provided in the apparatus of FIG. 4, operation may also be modified.

Suitable materials of construction will be apparent to those skilled in the art, and need not be discussed extensively. The use of synthetic resinous dielectric materials for the housing and associated parts and fittings will generally provide an optimum combination of safety, performance, and facility and economy of fabrication. The porous support member (which phrase as used herein as a generic expression for the so-called porous plates, membranes, and the like, that are conventionally used to support the fluidized bed) may be made of any suitable material, including the ceramics that have been widely used in the past; however, porous plastics (such as polyethylene) are preferred.

As indicated hereinbefore, virtually any particulate or finely divided material that is capable of receiving and retaining (at least for a short time) an electrostatic charge may be employed in the practice of the invention. Such materials are well known, and constitute a rather extensive list; by way of illustration, exemplary coating materials include inorganics, such as the phosphors, talc, chalk; organic resins and elastomers, such as the polyolefins (e.g. polyethylene, polypropylene, EPR, EPT, other interpolymers and copolymers, ionomers), the ethylenically unsaturated hydrocarbon polymers and derivatives (e.g. polyvinyl chloride, polyvinylidene chloride, polystyrene, polybutadiene, ABS), acrylic polymers, polyacetals, epoxy resins, cellulosics, polyamides; etc. In most cases, the specific coating material employed will dictate what, if any, treatment the workpiece will be subjected to (before or after deposition) in order to produce the sort of coating that is ultimately desired. Conventional treatments include heating (to enhance initial adherence of the coating material, to cure a B-stage resin or prepolymer, to fuse the particles of the deposit into a unified coating), adhesive coating, ultrasonic wave or actinic radiation exposure, etc., and the method of the invention is adapted to accommodate treatments of such nature.

The description of the illustrated embodiments suggests the wide variety of workpieces to which the principles of the invention are applicable. In fact, the variety is virtually endless, and includes any object that is capable of exhibiting an electrical potential that is effectively opposite to the charged particles (which is normally achieved by grounding the object and charging the particles negatively). Notwithstanding that the electrostatic effect is helpful in coating objects having reentrant or otherwise masked surfaces, and in producing uniformity in the deposit, the present invention may be employed to achieve especially outstanding results in those respects, by permitting dipping of the article deeply into the fluidized bed. The advantages of such dipping have previously been espoused by Gemmer (for example, in U.S. Pat. Nos. 2,844,489 and 2,974,059); however, the Gemmer inventions do not employ electrostatic principles and, because of the hazards involved, it is not believed that such deep dipping operation has heretofore been feasible in an electrostatic fluidized bed (of course, it is quite conventional to place the part into a fluidized bed of charged particles, as long as care is exercised to maintain adequate spacing of the part above the porous plate). Because the density of the bed is greatest at, or closely adjacent to, the porous support member, the advantages (primarily in terms of quickly producing desired deposits) of operating with the workpiece deeply immersed in the bed of particles will be evident. It is known that, by suitable control of the gas flow rate through the particulate mass, the bed may be caused to exhibit a lower, rather dense phase, and a contiguous upper phase that is of considerably lesser density. In such a case, if dip-coating is to be effected, locating the workpiece within the dense phase will normally produce the most desirable deposit in the shortest period of time.

Although not illustrated, it will be understood that the apparatus shown will frequently be employed in a system that includes other equipment. For example, since it is usually desirable to recover undeposited coating material and to prevent contamination of the surrounding area therewith, vacuum recovery apparatus will normally be associated with the fluidized bed unit. Similarly, the systems will usually include the ovens or the like that are necessary to perform the pre-and post-coating treatments hereinbefore alluded to, and gas and power control mechanisms, consoles, etc. will also be furnished in an integrated system.

Thus, it can be seen that the present invention provides novel electrostatic fluidized bed apparatus that is highly safe to operate, that is capable of efficiently, reliably and uniformly charging particulate materials, and that affords a high degree of design flexibility. The invention also provides a novel method for electrostatic coating in which the foregoing features and benefits are realized.

Having thus described the invention, what is claimed is:

1. An electrostatic coating method comprising the steps of: generating a stream of highly ionized gas at a location spaced by at least a minimum discharge distance of about 7.5 centimeters from a porous support member, said gas having an ionization value equivalent to air passed at about 3.0 to 15.0 standard cubic feet per minute through an electrode having a maximum resistance of about 0.05 ohm per centimeter and having applied to it a voltage of about 30 to 80 kilovolts; supplying to the upper surface of said support member particulate material that is capable of acquiring an electrostatic charge; passing said highly ionized gas along a flow path and thereafter upwardly through said support member, while substantially maintaining the ionization level thereof, to fluidize and efficiently electrostatically charge the particles of said material to produce a fluidized bed thereof; and placing in proximity to said fluidized bed a workpiece having a charge effectively opposite to said particles to thereby produce a coating thereof upon said workpiece, said minimum discharge distance being such as to prevent the passage of a substantial current from the source of said ionized gas to an electrically grounded member placed upon said upper surface of said support member.

2. The method of claim 1 wherein said minimum discharge distance is about 25 centimeters.

3. The method of claim 1 including the step of passing air through a porous mat of sharp edged metal fibers having a maximum resistance of about 0.5 ohm per centimeter, at a velocity of about 3.0 to 15.0 standard cubic feet per minute and while applying to said mat a voltage of about 30 to 80 kilovolts, to thereby generate said stream of highly ionized gas.

4. The method of claim 1 wherein said workpiece is placed within said fluidized bed of said particulate material to produce said coating thereon.

5. The method of claim 3 wherein said applied voltage is at least 50 kilovolts.

6. The method of claim 5 wherein said workpiece is placed within said fluidized bed of said particulate material to produce said coating thereon.

7. The method of claim 6 wherein the rate of flow of said ionized gas through said particulate material is controlled to produce in said fluidized bed a discernable lower dense phase and a less dense phase thereabove, and wherein said workpiece is placed within said dense phase to produce said coating thereon.

8. The method of claim 1 wherein said ionized gas is passed to said support member in a direction that is generally vertical, but that includes horizontal components to thereby increase the length of said gas flow path.

9. The method of claim 1 wherein said workpiece is an object of extended length, and wherein said step of placing said workpiece is proximity to said fluidized bed is effected by drawing said object upwardly therethrough.

* * * * *